United States Patent [19]

Francioni

[11] 4,020,905

[45] May 3, 1977

[54] CONSTRUCTION OF FIRE EXTINGUISHERS

[76] Inventor: Armando Francioni, Apartado Chacao No. 61.278, Caracas, Venezuela, 106

[22] Filed: Dec. 8, 1975

[21] Appl. No.: 638,544

[30] Foreign Application Priority Data

June 20, 1975 United Kingdom ..... 26405/75

[52] U.S. Cl. ..... 169/76; 169/77

[51] Int. Cl.[2] ..... A62C 35/50

[58] Field of Search ..... 169/76, 77, 85, 88

[56] References Cited

UNITED STATES PATENTS

| | | | |
|---|---|---|---|
| 1,866,981 | 7/1932 | Meigs | 169/77 |
| 1,945,457 | 1/1934 | Warr et al. | 169/77 |
| 2,328,345 | 8/1943 | Keefe, Jr. | 169/77 |
| 2,841,227 | 7/1958 | Betzler | 169/77 |

*Primary Examiner*—John J. Love

*Attorney, Agent, or Firm*—George H. Mitchell, Jr.

[57] ABSTRACT

A simplified extinguisher achieves a constant and uniform ratio between the impelling gas charge and the extinguishing material charge by directing the impelling gas downwardly into the discharge outlet at a lower level of the extinguisher charge; and expansion space for the extinguisher charge being provided to allow a mixing of the two charges at the outlet.

4 Claims, 1 Drawing Figure

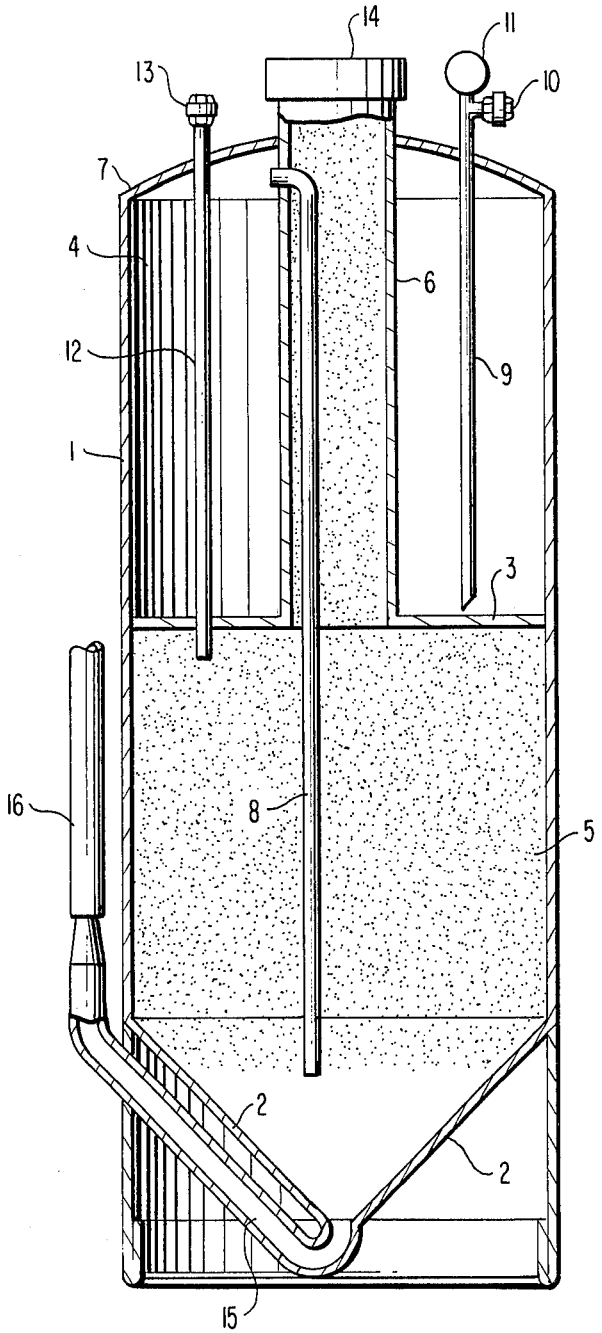
14
11
13
10
7
4
6
12
9
1
3
16
8
5
2
2
15

CONSTRUCTION OF FIRE EXTINGUISHERS

One of the negative factors presented by any type of gas operated extinguisher, of those now in use, is the necessity of having an impelling force of great magnitude, whose normal volume ranges around two thousand percent (2000 percent) in relation to the volume of the extinguishing charge. This is understandable if it is remembered that said extinguishers base their functioning on the expulsion of the extinguishing charge by the compression of its total volume on the output orifice, whereby the impelling charge must provide a mechanical compression having sufficient force so that, when it is converted into expelling pressure, sufficient and required power remains for accomplishing the purpose.

Also, the above-mentioned extinguishers the pressure exerted by the impelling charge and by the dispersion of the composition of the extinguishing charge is never uniform during the time that the impelling charge is moving the extinguishing charge, irrespective of whether the extinguishing charge moves out ahead of the impelling charge or in combination with it; thus, the range, or output pressure, of the extinguishing charge is notably reduced as a result.

On the basis of the above, and with the purpose of remedying it as much as possible, the applicant's investigations concentrated on reducing or eliminating said compressing force, whereby a high expelling force can be replaced by low pressure, with the consequent saving of space, volume and materials that are entailed.

This object has been achieved with entire satisfaction, by reducing the function of the impelling charge to that of a lubricant, by using said charge as an aid in the output of the extinguishing charge, without it being necessary to exert any pressure on extinguishing charge.

As said object was achieved, it was found that the results obtained brought a series of additional benefits, such as reduction of intermediate valves, unifying its handling on the valve of the spray nozzle, a considerable reduction of the volume, with the resulting saving of materials and manpower, which can be catagorized, in equalities of capacities, in order of 90 percent, and also complete portability.

And as an additional benefit, it was further found that said extinguisher has a greater versatility, since any airlike fluid impelling charge can be used in it, and as extinguishing charge, any of those materials commonly used for this purpose, such as lime, cement, water, specially prepared chemical compositions, etc.

These and other benefits and qualities will be brought out by the following description, besides those that may be obvious to persons skilled in the art.

In the accompanying drawing is shown a preferred embodiment of the invention, which is not to be construed as limiting the introduction of variations in its components, which do not alter its spirit and purpose.

Referring to said drawings, the single FIGURE is an axial section of the extinguisher, whereby there can be appreciated in full detail each of its constituent elements, and also their configuration and distribution.

A cylinder 1, having a lower end wall 2, is divided transversely by a partition 3 that delimits both chambers 4 and 5, and from whose center rises a cylindrical tubular part 6 which connects and expands lower chamber 5 to and above the closed upper wall 7 of cylinder 1, said tubular part being closed at its upper end by a cap 14, by which upper chamber 4 is hermetically sealed; a cylindrical tube 8, which projects from the upper of upper chamber 4 goes on below the plane of union between cylindrical parts 1 and conical part 2 of lower chamber 5, whereby there is established a communication between two said chambers; another cylindrical tube 9, which rises from the lower part of upper chamber 4 to come out above closed upper wall 7 of the extinguisher, whose end has a check valve 10 and a pressure gauge 11; a third and final tube 12, which places the upper part of lower chamber 5 in communication with the outside, and by the upper part of the extinguisher, which in said outside end has a shutoff valve 13.

At the lower extension of the apex of conical part 2, there is a tubular conduit 15, which is connected to a hose 16 which has the usual spray nozzle and a fast shutoff valve, not shown in the drawings.

For filling the extinguisher, the extinguishing charge is introduced in lower chamber 5 by tubular intake part 6, until the level of transverse partition 3 is reached, said introduction being facilitated by tubular connection 12, which in turn permits checking the level of filling, which done, cap 14 is closed, as is shutoff valve 13; through check valve 10 the impelling charge is injected into upper chamber 4, preferably said charge being made up of dry air compressed to an average pressure of 120 lbs., which is calibrated with gauge 11. During operation, when the impelling charge pases from chamber 4 to lower chamber 5, by tube 8, and strikes the sides of conical part 2; its pressure will cause the extinguishing charge to expand upward, introducing it into the space of tubular part 6, as indicated in the darkened part of the drawing, this arrangement permitting the impelling gas to mix with the extinguishing charge in the area around the discharge conduit 15.

In operation, it will suffice to open the fast shutoff valve of the spray nozzle, whereby the air contained in conical part 2, conduit 15 and hose 16, will be expelled producing a vacuum, which will be filled by the air of upper chamber 4, passing through tube 8; further, the weight of the extinguishing charge and the force of gravity will make the latter descend, which on mixing with the swirl of air that is formed on impact of the latter with the sides of conical part 2, will come out with it, successively until both are exhausted. In case the valve of the spray nozzle is cut off, the initial process will begin automatically, remaining ready for service, and under the same original conditions, since, although the air pressure has been reduced, the weight of the charge has also been reduced by the same percentage, both remaining in constant ratio.

I claim:

1. In a gas-operated extinguisher comprising a housing containing a first chamber for a charge of extinguishing material and a second chamber for an impelling charge of gas under pressure, said first chamber including a bottom wall defined by an inverted cone, discharge conduit means communicating with said first chamber at the apex of said cone, and a first tube having one end in communication with said second chamber and the other end being directed downwardly toward said bottom wall for impelling a charge of extinguishing material into said discharge conduit means, said first chamber including a lower section extending across the lower interior of the housing to contain the charge of extinguishing material and an upper section of narrower cross-section extending upwardly to provide an expansion space when said material is being discharged, said upper section communicating with the exterior of the housing and being provided with a closure member for filling the first chamber, said second chamber surrounding said upper section of the first chamber and including tube means communicating with the exterior of the housing for introducing gas under pressure into the second chamber.

2. The invention defined in claim 1, wherein said housing is cylindrical, one end of said cylindrical housing defining said bottom wall, the upper wall of said first chamber being defined by a transverse wall having a central opening therein, the upper section being defined by a tubular element extending axially upwardly from said opening and communicating with the exterior through the other end wall of the housing.

3. The invention defined in claim 1, wherein said discharge conduit means includes valve means for releasing extinguishing material with said impelling gas.

4. The invention defined in claim 1, which includes a second tube including a check valve and pressure gauge means communicating between the interior of the second chamber and the exterior of the housing for introducing impelling gas into the second chamber, and a third tube communicating between the interior of the first chamber and the exterior of the housing.

* * * * *